US005340412A

United States Patent [19]

Yoshino et al.

[11] Patent Number: 5,340,412

[45] Date of Patent: Aug. 23, 1994

[54] METHOD OF FLUORINATED NITRIDING OF AUSTENITIC STAINLESS STEEL SCREW

[75] Inventors: Akira Yoshino, Osakasayama; Massaki Tahara, Takatsuki; Haruo Senbokuya, Tondabayashi; Kenzo Kitano, Kawachinagano; Teruo Minato, Hashimoto, all of Japan

[73] Assignee: Daidousanso Co., Ltd., Osaka, Japan

[21] Appl. No.: 57,497

[22] Filed: May 6, 1993

Related U.S. Application Data

[62] Division of Ser. No. 758,829, Sep. 12, 1991.

[30] Foreign Application Priority Data

Aug. 31, 1991 [JP] Japan ..... 3-246790

[51] Int. Cl.[5] ..... C21D 9/00

[52] U.S. Cl. ..... 148/208; 148/218; 148/231; 148/587

[58] Field of Search ..... 148/208, 218, 231, 587

[56] References Cited

U.S. PATENT DOCUMENTS

| | | | |
|---|---|---|---|
| 136,213 | 2/1873 | Cochrane | 148/14 |
| 1,660,960 | 2/1928 | Greenslade | 148/12.1 |
| 1,958,575 | 5/1934 | Hengstenberg | 148/16 |
| 2,263,527 | 11/1941 | Werme | 10/10 |
| 2,299,138 | 10/1942 | Gier, Jr. | 148/17 |
| 2,851,387 | 9/1958 | Low | 148/16.6 |
| 3,140,205 | 7/1964 | Malcolm | 148/16.6 |
| 3,344,817 | 10/1967 | Connard | 148/12.1 |
| 3,804,678 | 4/1974 | Kindlimann | 148/16.6 |
| 3,943,010 | 3/1976 | Hartline, III | 148/16.6 |
| 4,011,111 | 3/1977 | Hook | 148/16 |
| 4,046,601 | 9/1977 | Hook | 148/20 |
| 4,062,701 | 12/1977 | Juhas | 148/12.1 |
| 4,154,629 | 5/1979 | Asai et al. | 148/16.6 |
| 4,184,899 | 1/1980 | Blas et al. | 148/16.6 |
| 4,233,880 | 11/1980 | Bjorklund et al. | 148/587 |
| 4,242,151 | 12/1980 | Leveque | 148/16.6 |
| 4,264,380 | 4/1981 | Rose et al. | 148/16.6 |
| 4,268,323 | 5/1981 | Jakubowski et al. | 148/20 |
| 4,366,008 | 12/1982 | Takeuchi et al. | 148/143 |
| 4,464,207 | 8/1984 | Kindlimann | 148/16.6 |
| 4,717,300 | 1/1988 | Alvi et al. | 148/12.1 |
| 4,975,147 | 12/1990 | Tahara et al. | 156/646 |
| 5,013,371 | 5/1991 | Tahara et al. | 148/16.6 |

FOREIGN PATENT DOCUMENTS

| | | |
|---|---|---|
| 3235447 | 5/1983 | Fed. Rep. of Germany . |
| 2155078 | 5/1973 | France . |
| 2404142 | 4/1979 | France . |
| 62-40319 | 3/1987 | Japan . |
| 62-40320 | 3/1987 | Japan . |

OTHER PUBLICATIONS

Patent Abstract of Japan, vol. 007, No. 181 (C-180) Aug. 10, 1983 of JP-A-58 084 968 (Daini Seikosha KK) May 21, 1983.

*Primary Examiner*—Upendra Roy

*Attorney, Agent, or Firm*—Armstrong, Westerman, Hattori, McLeland & Naughton

[57] ABSTRACT

An austenitic stainless steel screw having a nitride hard layer on its surface to prevent corrosion on parts of the screw such as a screw head which is in contact with the environment by removing a portion of the nitride hard layer to expose austenitic stainless steel base. By contrast, in the thread part and the like of the screw, the nitride hard layer is retained to improve the hardness and the tapping functions of the screw. In the method for manufacturing, the austenitic stainless steel screw is exposed to a fluorine-or fluoride-containing gas atmosphere prior to nitriding to form a fluoride film on its surface and then is nitrided in that state. Accordingly, the so formed nitride hard layer becomes uniform and deep to obtain an austenitic stainless steel screw having excellent surface properties.

4 Claims, 2 Drawing Sheets

METHOD OF FLUORINATED NITRIDING OF AUSTENITIC STAINLESS STEEL SCREW

This is a division of application Ser. No. 07/758,829, filed Sep. 12, 1991.

TECHNICAL FIELD

This invention relates to a hard austenitic stainless steel screw which is excellent in corrosion resistance and a method for manufacturing the same.

PRIOR ART

Generally, an austenitic stainless steel is higher in corrosion resistance against acid or salt compared with a carbon steel. However, in surface hardness and strength, it is inferior to the carbon steel. Therefore, it is not proper to use this stainless steel for a screw which particularly requires the ability to tighten to an iron-based plate by self-tapping, such as a tapping screw, a self-drilling screw and a dry wall screw. For this purpose, plated carburized iron articles or 13 Cr stainless steel articles are used. It is pointed out as some drawbacks that these articles are not only inferior in oxidation resistance (rust resistance) to the austenitic stainless steel articles but are also weak in their tightening function due to corrosion of their base material by acid rain, which is one of the big environmental problems these days. In this aspect, the austenitic stainless steel articles are far superior in acid resistance. Accordingly, the inventors provided a new technology for maintaining the tapping property as well as carburized iron articles by nitriding-hardening the austenitic stainless steel screw(Japanese Patent Application Nos. 177660/1989 and 267729/1990).

According to the technology, a nitrided hard layer can be formed on the whole surface of the austenitic stainless steel screw by which even a thick iron plate is drilled and tapped. However, the new technology holds a serious defect that the so formed nitrided hard layer lacks enough of the corrosion resistance characteristic of austenitic stainless steel. For example, when of using an austenitic stainless steel screw having a so formed nitrided hard layer, its screw head exposed to the outside easily rusts. Generally, when using (tightening) a screw, its head and the area around the head are visible, being exposed to the outside. An austenitic stainless steel screw as commercial goods is devaluated by even a bit of change in color of its screw head due to rust. It is possible to conduct plating or color-painting to tile surface of a nitrided hard layer after nitriding in order to prevent rust from generating there. However, this is only a temporary solution and not a fundamental one. So as to protect the screw head or the like against nitriding, it was proposed to apply some methods, such as a copper-plating and a masking by flame coating, to the parts prior to nitriding. Even if these methods are conducted, it is difficult to completely prevent nitriding the surface of the austenitic stainless steel base of the portion.

SUMMARY OF THE INVENTION

Accordingly, it is the object of the invention to provide a hard austenitic stainless steel screw which has the same tapping property and the like as carburized iron articles and to improve the corrosion resistance of visible parts thereof exposed to outside in use, such as the head part, to exclude generating rust and the like.

To accomplish the above-mentioned purpose, the invention provides a hard austenitic stainless steel screw, characterized in that a nitrided hard layer is formed on the surface of tile austenitic stainless steel screw, and that the nitrided layer of predetermined parts of the nitrided screw is removed. The inventor also includes a method for manufacturing a hard austenitic stainless steel screw comprising steps of heating an austenitic stainless steel screw in a nitriding atmosphere to form a nitrided hard layer on the screw surface, and removing the nitrided hard layer of predetermined parts of the austenitic stainless steel screw partially.

During tile process of accumulated research for preventing rust from generating on a head part and the like of an austenitic stainless steel screw, the inventors came to have an idea to remove a nitrided hard layer from the head part or the like and conducted a series of tests to prove it. As a result, they found out that even if the nitrided hard layer was removed from the head part or the like of the screw, tapping and drilling functions, which had been improved by nitriding, would never be deteriorated and, what was more, corrosion resistance would be improved. A nitrided hard layer of the austenitic stainless steel screw generally has a thickness of 30 to 200 μm and preferably 40 to 80 μm for improving tapping and drilling functions. Sixty to seventy percent total thickness of the nitrided hard layer comprises an alloy surface layer including a large amount of intermetallic compounds such as CrN and $Fe_x N_y$, and a diffused inner layer of a solid solution of N and C. The alloy layer formed on the outermost surface of the nitrided hard layer suffers from severe deterioration in corrosion resistance due to considerable decrease in concentration of solid soluble Cr. On the other hand, an inner diffused layer is superior to the alloy layer in corrosion resistance but not sufficient compared with a pure austenitic stainless base of the core portion. For example, in case of forming a nitrided hard layer by nitriding, it takes 4 to 8 hours for the surface of the nitrided hard layer to generate rust in a neutral salt spray test, 500 to 700 hours for a diffused layer after removing the alloy layer from the nitrided hard layer, and over 2000 hours for a pure austenitic base which is the core exposed by removal of the whole nitrided layer. It means that corrosion resistance can be improved without deteriorating tapping and drilling functions which were strengthened by nitriding when the nitrided hard layer was removed from the screw head and the like exposed to outside in a tightened state.

DETAILED DESCRIPTION OF THE PREFERRED EMBODIMENTS

In this invention, of the nitrided hard layer formed over the entire surface of an austenitic stainless steel screw, the nitrided layer formed on the screw head, the neck portion and the like of the screw is partially removed which is in contact with the outside when tightened. The removed part exposes the austenitic stainless steel base to accomplish rust prevention due to the a corrosion resistance characteristic of the austenitic stainless steel.

The above-mentioned nitrided hard layer formed on the whole surface of the austenitic stainless steel screw comprises an alloy surface layer and a diffused inner layer as mentioned above. In general, the alloy surface layer has a thickness of 15 to 50 μm and a surface hardness (Hv) of 750 to 1400 and the inner diffused layer has a thickness of 20 to 100 μm and a surface hardness (Hv) of 320 to 650.

In this invention, the nitrided hard layer comprising an alloy layer and a diffused layer of the screw head portion and thle like is partially removed.

The means of the removal includes a chemical method such as a dipping treatment and the like in which a screw head and the like of tile austenitic stainless steel screw is dipped in a mixed acid, for example, $HCl+HNO_3$ and $HF+HNO_3$, or in a single acid solution of HNO, heated to about 60°C., or a mechanical method such as scouring.

In the case of removing the nitrided hard layer by the chemical method, the portion to retain the entire nitrided layer is masked by coating agent not denatured by acid before dipping in the acid, the only the head and neck portions of the austenitic stainless steel screw are dipped in acid. In this case, it is possible to appropriately control the type and concentration of the acid, the temperature, and the dipping time according to the condition of the nitrided hard layer to be removed. This method of removing tile nitrided hard layer has the advantage that the portion of the nitrided hard layer to be removed is selective.

When the nitrided hard layer is removed in this way, the diameter of some portions of an austenitic stainless steel screw, such as a screw head and a neck part, where the nitrided hard layer is removed, becomes small, so that the diameter of tile screw head and the neck part connected thereto are ordinarily designed to be larger, the light of the thickness of a nitrided hard layer to be removed. Accordingly, deterioration in strength of breaking the torque due to decrease in tightening function of the screw and in diameter of the head and neck portions is prevented.

Examples of manufacturing a hard austenitic stainless steel screw according to the present invention are described in detail as follows.

In the present invention, an austenitic stainless screw is held preliminary in a fluorine- or fluoride-containing gas atmosphere to form a fluorinated layer on the steel surface, then heated in a nitriding atmosphere to remove the fluorinated layer and at the same time, to convert the surface layer of the screw into a nitrided layer. The nitrided layer of predetermined portions of the screw is removed out of the whole nitrided layer to prevent rust from generating.

The term "fluorine- or fluoride-containing gas" as used in the above-mentioned pretreatment prior to nitriding means a dilution of at least one fluorine source component selected from among $NF_3$, $BF_3$, $CF_4$, HF, $SF_6$, $F_2$, $CH_2F_2$, $CH_3F$, $C_2F_6$, $WF_6$, $CHF_3$, $SiF_4$, and the like contained in an inert gas such as $N_2$. Among these fluorine source components, $NF_3$ is most suitable for practical use since it is superior in reactivity, ease of handling and other aspects to the others. As mentioned previously, in the present invention, the screws are held in the above-mentioned fluorine- or fluoride-containing gas atmosphere at a temperature of, for example, 250° to 400° C. in the case of $NF_3$, for a preliminary treatment of the surface of an austenitic stainless screw and then subjected to nitriding (or carbonitriding) using a known nitriding gas such as ammonia. When $F_2$ gas alone or a mixed gas composed of $F_2$, gas and an inert gas, for example, is used as the fluorine- or fluoride-containing gas in a special case, the above-mentioned holding temperature is arranged in the range of 100° to 250°C. The concentration of the fluorine source component, such as $NF_3$, in such fluorine- or fluoride-containing gas should amount to, for example, 1,000–100,000 ppm, preferably 20,000–70,000 ppm, more preferably 30,000–50,000 ppm. The holding time in such a fluorine- or fluoride-containing gas atmosphere may appropriately be selected depending on the steel species, geometry and dimensions of screws, heating temperature and so forth, generally within the range of ten or so minutes or scores of minutes.

To be more concrete in illustrating the aforementioned pretreatment using fluorine- or fluoride-containing gas and nitriding treatment, austenitic stainless screws X having a head portion A, a neck portion B and a thread portion C as shown in FIG. 1, for instance, are degreased and then charged into a heat treatment furnace 1 such as shown in FIG. 2. This furnace 1 is a pit furnace comprising an inner vessel 4 surrounded by a heater 3 disposed within an outer shell 2, with a gas inlet pipe 5 and an exhaust pipe 6 being inserted therein. Gas is supplied from cylinders 15 and 16 via flow meters 17, a valve 18 and the like into the gas inlet pipe 5. The inside atmosphere is stirred by means of a fan 8 driven by a motor 7. The screws X placed in a metallic container 11 are charged into the furnace. In FIG. 2, the reference numeral 13 indicates a vacuum pump and 14 a noxious substance eliminator. A fluorine- or fluoride-containing reaction gas, for example, a mixed gas composed of $NF_3$ and $N_2$, is introduced into this furnace and heated, together with the screws, at a predetermined reaction temperature. At temperature of 250°–400° C., $NF_3$ evolves fluorine in the nascent state, whereby the organic and inorganic contaminants on the surface of the screws are eliminated therefrom and at the same time this fluorine rapidly reacts with the base elements Fe and chromium on the surface and/or with oxides occurring on the steel work surface, such as FeO, $Fe_3O_4$ and $Cr_2O_3$. As a result, a very thin fluorinated layer containing such compounds as $FeF_2$, $FeF_3$, $CrF_2$, $CrF_4$ and the like is formed in the metal composition on its surface, for example as follows:

$$FeO+2F \rightarrow FeF_2 \tfrac{1}{2}O_2$$

$$Cr_2O_3+4F \rightarrow 2CrF_2+3/2O_2$$

These reactions convert the oxidized layer on the surface of the screws X to a fluorinated layer. At the same time, $O_2$ adsorbed on the surface is removed therefrom. Where $O_2$, $H_2$ and $H_2O$ are absent, this fluorinated layer is stable at temperature up to 600° C. and it is considered that the stable fluorinated layer prevents oxidized layer formation on the base metal and absorption of $O_2$ thereon until the subsequent step of nitriding. A fluorinated layer, which is similarly stable, is formed on the furnace surface as well and minimizes damages to the furnace material.

The screws X thus treated with such fluorine- or fluoride-containing reaction gas are then heated at a nitriding temperature of 480°C.–700° C. Upon addition of $NH_3$ or a mixed gas composed of $NH_3$ and a carbon source gas (e.g. RX gas) in the heated condition, the fluorinated layer undergoes reduction or destruction by means of $H_2$ or a trace amount of water to give an active metal base comprised of austenitic stainless steel, as shown, for example, by the following reaction equations:

$$CrF_4+2H_2 \rightarrow Cr+4HF$$

$$2FeF_3+3H_2 \rightarrow 2Fe+6HF$$

Upon formation of such active base metal, active N atoms are adsorbed thereon, then enter the metal structure and diffuse therein and, as a result, a chemical compound layer (a nitrided hard layer) containing such nitrides as CrN, $Fe_2N$, $Fe_3N$ and $Fe_4N$ is formed on tile surface.

The thus obtained nitrided hard layer comprises an alloy surface layer and a diffused inner layer and covers all the screw X shown in FIG. 1. This invention contemplates removing the a nitrided hard layer on, for example, the whole head portion A and a part of tile neck portion B of the screw X shown in FIG. 1, and to leave the nitrided hard layer on the thread portion C and rest of the neck portion B. The removal is, for example, conducted by heating $HNO_3$–HF solution at about 50° C., dippins the whole head portion A and a part of the neck portion B of the screw therein for about 10 to 120 minutes to dissolve and remove the nitrided hard layer. It is efficient to remove the nitrided layer chemically, but in some cases, removal may be conducted by scouring with a scourer or the like. In the screws to which tile removal treatment is conducted, the nitrided hard layer of the whole head portion and a part of the neck portion is removed in this way to expose austenitic stainless steel . Owing to this treatment, the screw X has sufficient corrosion resistance resulted from the austenitic stainless steel. The remaining nitrided hard layer of a part of the neck portion B and the thread portion C significantly improves its hardness compared with that of austenitic stainless steel to give the screw the same excellent tapping and tightening functions as carburized iron articles.

The present invention has been described using a screw as an example so far, but a bolt is also included within the definition of screw as used herein. In the aforementioned description, nitriding is conducted by using $NH_3$ or a mixed gas comprising $NH_3$ and a gas containing a carbon source, but nitriding by a glow discharge or by salt bath may be substituted for this nitriding.

Followings are descriptions of embodiments.

EXAMPLE 1

Figure 2:
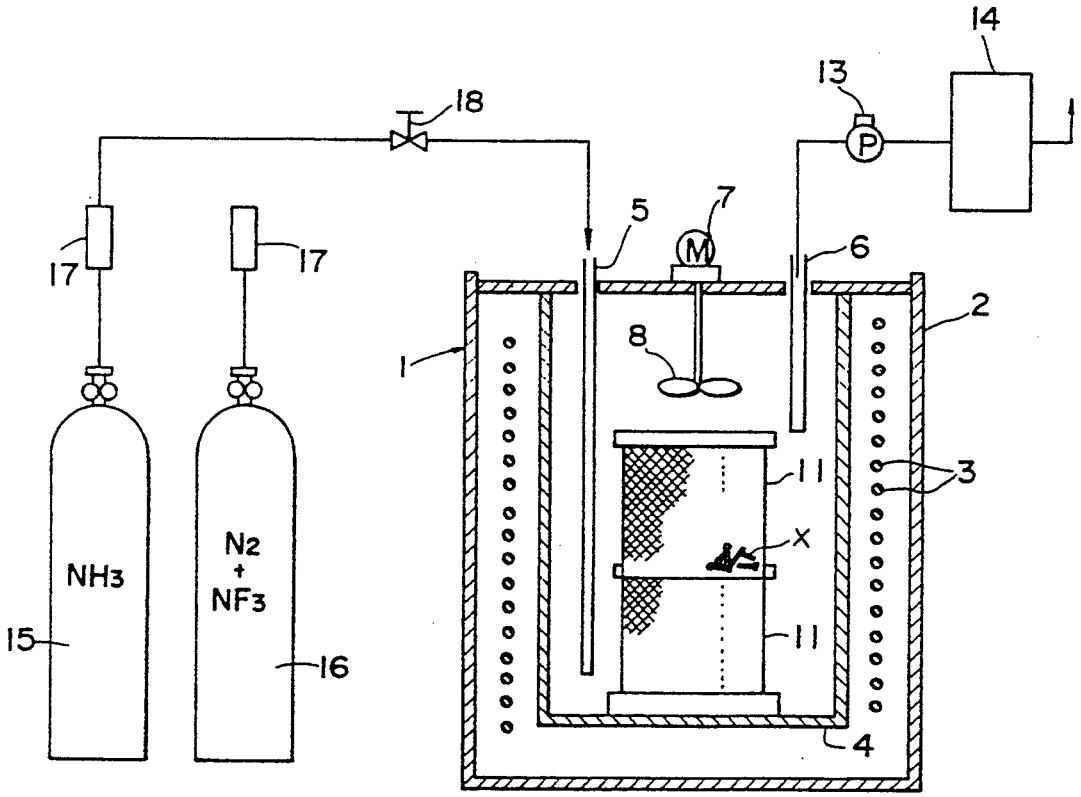
FIG. 2 shows a cross-sectional view illustrating an example of a nitriding furnace.

Cross recessed head tapping screws of SUS305, austenitic stainless steel (4.2 mmϕ×19 mm) were cleaned with trichloroethylene, then charged into a treatment furnace 1 as shown in FIG. 2, and held at 380° C. for 15 minutes in an $N_2$ gas atmosphere containing 5,000 ppm of $NF_3$ for fluoriding, then heated at 530° C., and a nitriding treatment was carried out at that temperature for 3 hours while a mixed gas composed of 50% $NH_3$ plus 50% $N_2$ (hereinafter: % by volume) was introduced into the furnace. The screws were then air-cooled and removed from the furnace. Thus obtained screws had a nitrided hard layer with thickness of 40 μm wholely. A portion of the nitrided screw except a head portion and a part of a neck portion which is a 4 mm below portion from the head out of the neck portion was coated with vinyl chloride resin liquid and dried to cover the screw with the coat. Then the screw was dipped in 10% concentration solution of $HNO_3$ at 63° C. for 15 minutes, taken out, washed with water and dried. As a result, surface hardness (Hv) of a part of the tapping screw masked with the coat (mainly a thread portion) was 1000 to 1100. On the contrary, the head part of the tapping screw with the nitrided hard layer removed therefrom by the acid treatment had a surface hardness of 340 to 380. A salt spray test (Corrosion acceleration test) was conducted against the tapping screw and it was found that rust was not caused even after 2000 hours on the head part and a part of the neck portion in which the austenitic stainless steel base was exposed. On the contrary, it was found that rust was caused after 6 hours on the part (mainly the thread part) in which the nitrided hard layer was not removed. A drilling test was conducted to the above-mentioned screw and it was found that the same property as the conventional tapping screw (carburized iron steel workpieces) was given.

EXAMPLE 2

Figure 3:
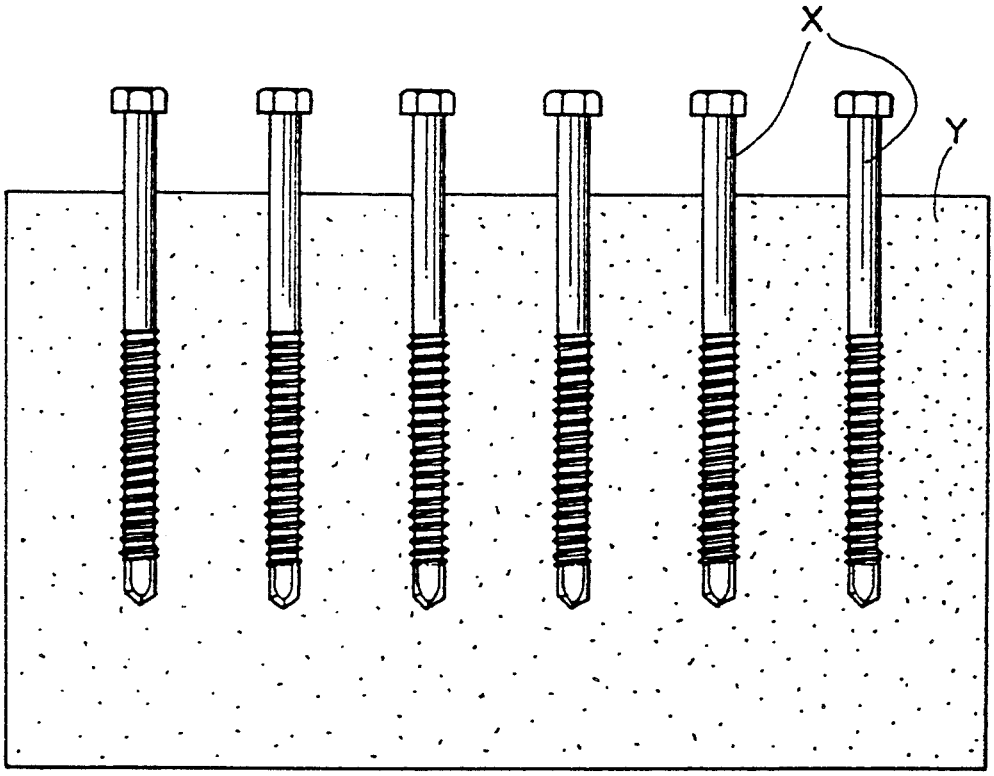
FIG. 3 shows an explanatory view illustrating an example wherein the nitrided hard layer of predetermined portions of a screw is removed.

Self-drilling screws of SUS 305, austenitic stainless steel hexagon head, 4.8 mmϕ×25 mm) were nitrided as well as in the Example 1. In this case, the nitrided hard layer was formed on the whole self-drilling screw and its thickness was 55 μm. A portion of the nitrided screw except the head portion and a part of a neck portion which is 5 mm below the head portion of the whole neck portion was dipped in vinyl chloride resin liquid and dried to cover the screw with a coating film. Then a plurality of the screw were screwed in a polystyrene resin plate having a thickness of 30 mm as shown in FIG. 3. The resin plate was floated upside down on strong acid solution ($HNO_3$:HCl=3:1), taken out after 5 minutes passed and furthermore floated on 10% concentration solution at 60° C. for 10 minutes as well as the above condition. Then the self-drilling screws were removed from the polystyrene resin plate, washed with water and dried. The dried screws were plated with Zn by a conventional plating method. A drilling test of thus obtained screws was conducted against a steel plate with a thickness of 3.2 mm (SPCC). The average drilling time in this case was 3.1 seconds. The time could be shortened by 20% on the average compared to a conventional self-drilling screw (carburized iron screw). The result of a salt spray test thereto was the same as in the Example 1.

EXAMPLES 3

Figure 1:
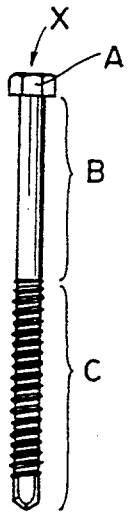
FIG. 1 shows a front view of an austenitic stainless steel self-drilling screw as an object of the invention.

Self-drilling screws of austenitic stainless steel (hexagon head, 6.3 mmϕ×150 mm) as shown in FIG. 1 were nitrided as well as in the Example 1. Thus obtained self-drilling screws were entirely covered with a nitrided hard layer and the thickness thereof was 75 μm. A part of the nitrided screw except the head portion and the part of the neck portion which is a 100 mm below tile head was dipped in vinyl chloride resin liquid and dried to cover the screw with a coating film. Then the screw was dipped in a strong acid solution ($HNO_3$:HCl=3:1) at 45° C. for 5 minutes and additionally dipped in solution with 10% concentration solution of $HNO_3$ at 60° C. for 5 minutes, taken out, washed with water and dried. A salt spray test was conducted to thus treated screw and the same result as in the Example 1 was obtained, and the result of a drilling test was also the same as in the Example 2. The breaking torque value of thus obtained austenitic stainless self-drilling screw was examined. The value was 7% lower than an austenitic stainless steel screw self-drilling of which the whole surface was covered by a nitrided hard layer without the acid dipping treatment. In order to avoid the deterioration of the breaking torque value, austenitic stainless steel self drilling screws of which the diameter of the screw head and the neck portion were previously made large (about 150 μm) were manufactured. They were nitrided and then dipped in acid to remove the nitrided hard layer of the screw head portion and neck portion. After eliminating the nitrided hard layer of the head and neck portions, the diameters of the head and neck portions were decreased as designed previously.

Consequently the breaking torque value was equal to an austenitic stainless steel self-drilling screw of which the whole surface layer was covered with a nitrided hard layer and the whole part has diameter as previously designed respectively.

EFFECT OF THE INVENTION

As mentioned above, in the austenitic stainless steel screw according to the present invention, a nitrided hard layer is removed from predetermined portions, such as the screw head portion and the neck portion, so that austenitic stainless steel base is exposed on these portions. The head portion is exposed to the outside when screwed into place and influenced by acid rain or the like, and the neck portion is in contact with rain and the like penetrating from outside. The portions where the nitrided layer is removed maintain as a good a corrosion resistance as that of the austenitic stainless steel itself. On the other hand, in the thread portion thereof, its hardness and the like are improved largely by the nitrided hard layer, so that surface hardness and strength thereof becomes approximately equal to that of carbon steel products to be able to tap and tighten by itself.

In the method according to the present invention, prior to nitriding the abovementioned austenitic stainless steel screw, the screw is held in a fluorine- or fluoride-containing gas atmosphere to form a fluoride layer on the surface thereof. In that state the screw is nitrided, so that the formed nitrided layer is uniform and deep to give a hard austenitic stainless steel screw having good surface properties.

What is claimed is:

1. A method for manufacturing a hard austenitic stainless steel screw comprising steps of heating an austenitic stainless steel screw having a surface in a gaseous atmosphere containing nitrogen to form a nitrided surface layer on the surface over a core of austenitic stainless steel, the nitrided surface layer having a thickness of 18–140 μm and a hardness of 750–1400 Hv, and removing the nitrided layer on a portion of the austenitic stainless steel screw to expose the core of austenitic stainless steel.

2. A method for manufacturing a hard austenitic stainless steel screw as defined in claim 2, wherein removal of the nitrided surface layer is conducted by dipping a portion of the screw in a strong acid.

3. A method for manufacturing a hard austenitic stainless steel screw comprising steps of holding an austenitic stainless steel screw having a surface in a fluorine- or fluoride- containing gas atmosphere to form a fluorinated layer on the surface, heating the fluorinated screw in a gaseous atmosphere containing nitrogen to form the fluorinated layer into a nitrided surface layer over a core of austenitic stainless steel, the nitrided surface layer having a thickness of 18–140 μm and a hardness of 750–1400 Hv, and removing the nitrided layer on a portion of the austenitic stainless steel screw to expose the core of austenitic stainless steel.

4. A method for manufacturing a hard austenitic stainless steel screw as defined in claim 3, wherein removal of the nitrided surface layer is conducted out by dipping a portion of the screw in a strong acid.

* * * * *

UNITED STATES PATENT AND TRADEMARK OFFICE

CERTIFICATE OF CORRECTION

PATENT NO. : 5,340,412

DATED : August 23, 1994

INVENTOR(S) : Yoshino et al

It is certified that error appears in the above-indentified patent and that said Letters Patent is hereby corrected as shown below:

On the title page, item [30], line 2, "Massaki Tahara" should read --Masaaki Tahara--.

Signed and Sealed this

Fifteenth Day of November, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO.: 5,340,412
DATED : August 23, 1994
INVENTOR(S): YOSHINO et al.

It is certified that error appears in the above-identified patent and that said Letters Patent is hereby corrected as shown below:

On the title page of the patent in item [30] the foreign priority data, should read --Oct. 14, 1990 [JP] Japan .....2-267729--.

Signed and Sealed this

Twenty-seventh Day of June, 2000

*Attest:*

*Attesting Officer*

Q. TODD DICKINSON

*Director of Patents and Trademarks*